United States Patent [19]

Patteson et al.

[11] Patent Number: 4,777,673

[45] Date of Patent: Oct. 18, 1988

[54] VERTICALLY DRAWN SHOWER CURTAIN

[75] Inventors: W. Mark Patteson, Willowdale; Robin I. Saunders, Toronto, both of Canada

[73] Assignee: Marsaun Enterprises, Willowdale, Canada

[21] Appl. No.: 911,282

[22] Filed: Sep. 23, 1986

[51] Int. Cl.[4] ..... A47K 3/00

[52] U.S. Cl. ..... 4/558; 4/608; 160/84.1; 160/123

[58] Field of Search ..... 4/607, 608, 557, 558; 160/DIG. 6, 168 R, 84 R, 123, 126, 131, 166 R, 166 A, 183, 196, 330

[56] References Cited

U.S. PATENT DOCUMENTS

| | | | |
|---|---|---|---|
| 2,168,046 | 8/1939 | Ruscher | 160/168 |
| 2,243,910 | 6/1941 | Laborda | 160/168 |
| 2,824,607 | 2/1958 | Sosower | 160/62 |
| 2,929,074 | 3/1960 | Spector | 4/557 |
| 2,936,463 | 5/1960 | Tracy | 4/607 |
| 2,980,180 | 4/1961 | Stephens et al. | 160/168 X |
| 4,122,559 | 10/1978 | Kelly | 4/608 |

*Primary Examiner*—Charles E. Phillips
*Attorney, Agent, or Firm*—Rogers, Bereskin & Parr

[57] ABSTRACT

This invention relates to a vertically drawn shower curtain having a raised position and a lowered position and being movable therebetween, for preventing water from escaping from a shower enclosure. The shower curtain is composed of waterproof panels, flexible hanging straps, clamps, and drawstrings. In the lowered position, the hanging straps support the panels in an inwardly overlapping relationship. The hanging straps are attached to the upper edge of each panel, leaving the lower edge free to rotate inwardly. The hanging straps have guides for the drawstrings. The drawstrings are attached to the lowest panel, are lead through the guides, and then through an eyelet on the clamp. All drawstrings terminate in a single pull ring. In the raised position, the panels are supported in a substantially nested relationship, by the combination of the drawstrings and clamps. The shower curtain may also include a valence panel, supported by the clamps, to hide the workings of the drawstrings and the clamps. The panels may also include deformable stiffening members along the upper edges of the panels.

14 Claims, 3 Drawing Sheets

VERTICALLY DRAWN SHOWER CURTAIN

BACKGROUND OF THE INVENTION

This invention relates generally to shower curtains, and more particularly to a vertically drawn shower curtain for use in preventing spray from splashing out of a shower enclosure. In addition, this invention relates to a vertically drawn shower curtain that overcomes some of the disadvantages of previously known conventional and vertically drawn shower curtains, and is adaptable to tubs having more than one open wall.

Conventional one piece shower curtains, whether of the vertically drawn roller type, or the more standard hanging type that must be pushed to the side when not in use, have an inherent structural disadvantage. Normally, the rush of water from a shower creates substantial air currents in and around the shower enclosure. This is especially true of hot water showers which create substantial updrafts. With one piece hanging shower curtains such air currents are sufficient to dislodge the edge of the shower curtain from the wall of the shower enclosure or from the edge of the tub. If it pulls away from the wall, water can escape. If it pulls away from the tub, it can interfere with the person taking the shower and water can splash out of the tub. Magnets, formed into the hem of the shower curtain, have been tried as one method of making the seal between the curtain and the tub more effective. However, not all tubs are magnetic. Also, very few walls are capable of being sealed magnetically.

There are other problems with conventional hanging shower curtains. Normally, they are pushed to one side when not in use but this can cause problems as mold and mildew can form in the places where one fold of the curtain overlaps and comes into contact with another fold. Also, even with the shower curtain pushed to one side, the shower curtain is still quite visible, and may look untidy.

In order to overcome some of the problems with conventional shower curtains, vertically drawn shower curtains have been proposed, in the form of shower curtains that are rolled up. Specifically, shower curtains have been proposed that roll up and around the shower rod through the use of an appropriate rolling mechanism. For example, U.S. Pat. No. 3,222,689 in the name of Efron and U.S. Pat. No. 4,122,559 in the name of Kelly both disclose vertically drawn shower curtains.

However, while creating a neat appearance by being tightly rolled around the shower rod, there are some inherent disadvantages to these inventions. Firstly, if the shower has been used, the shower curtain will be wet. Therefore, if it is rolled up into a tight roll, there is an opportunity for mildew or mold to grow in the moist, tightly enclosed roll. Consequently, U.S. Pat. No. 3,222,689 to Efron discloses a squeegee. The squeegee is located just below the rolling axis of the shower, and is intended to remove all surface water from the shower curtain as it is being wrapped into a tight roll. U.S. Pat. No, 4,122,559, to Kelly discloses a pair of sponge rollers, also located just below the rolling axis of the shower curtain, which are intended to remove excess water.

In each of these devices, however, the necessity of adding additional structures to remove water from the shower curtain increases the manufacturing costs for the device. Also, if for example the sponge rollers become saturated before the curtain is fully retracted, or if the squeegee is ineffective in removing all of the water, then mildew and mold are likely to grow in the moist tightly enclosed roll. Further, these inventions do not even address the problems caused by the air currents created when the shower is turned on.

In modern bathroom styles, it is becoming more common to include free-standing tubs. A free-standing tub may be defined as a tub with more than one open wall. To provide a shower curtain for such a tub requires one that may be adapted to go around one or more corners, and that may conform to whatever shape the tub may take. Therefore, an additional disadvantage of the roller type of vertically drawn shower curtains that have been previously proposed, is that the roller mechanisms are not adaptable to the shapes of modern free-standing tubs.

SUMMARY OF THE INVENTION

According to the present invention, there is provided a suspended vertically drawn shower curtain having a raised position, and a lowered position and being movable therebetween. The shower curtain includes: a plurality of flexible waterproof panels each having an upper edge and a lower edge; a means for hanging said panels in an inwardly overlapping relationship said panels being suspended by said upper edges from said hanging means, said lower edges of each of said panels being free to rotate inwardly and upwardly when said shower curtain is in the lowered position; and a means for raising and lowering said shower curtain, said panels, in the raised position being suspended in a side by side relationship from said raising and lowering means and said hanging means being located between every adjacent panel to maintain the panels in spaced apart relationship to allow the panels to air dry.

BRIEF DESCRIPTION OF THE DRAWINGS

In the drawings, which illustrate preferred embodiments of the present invention.

DESCRIPTION OF THE PREFERRED EMBODIMENT

Figure 1:
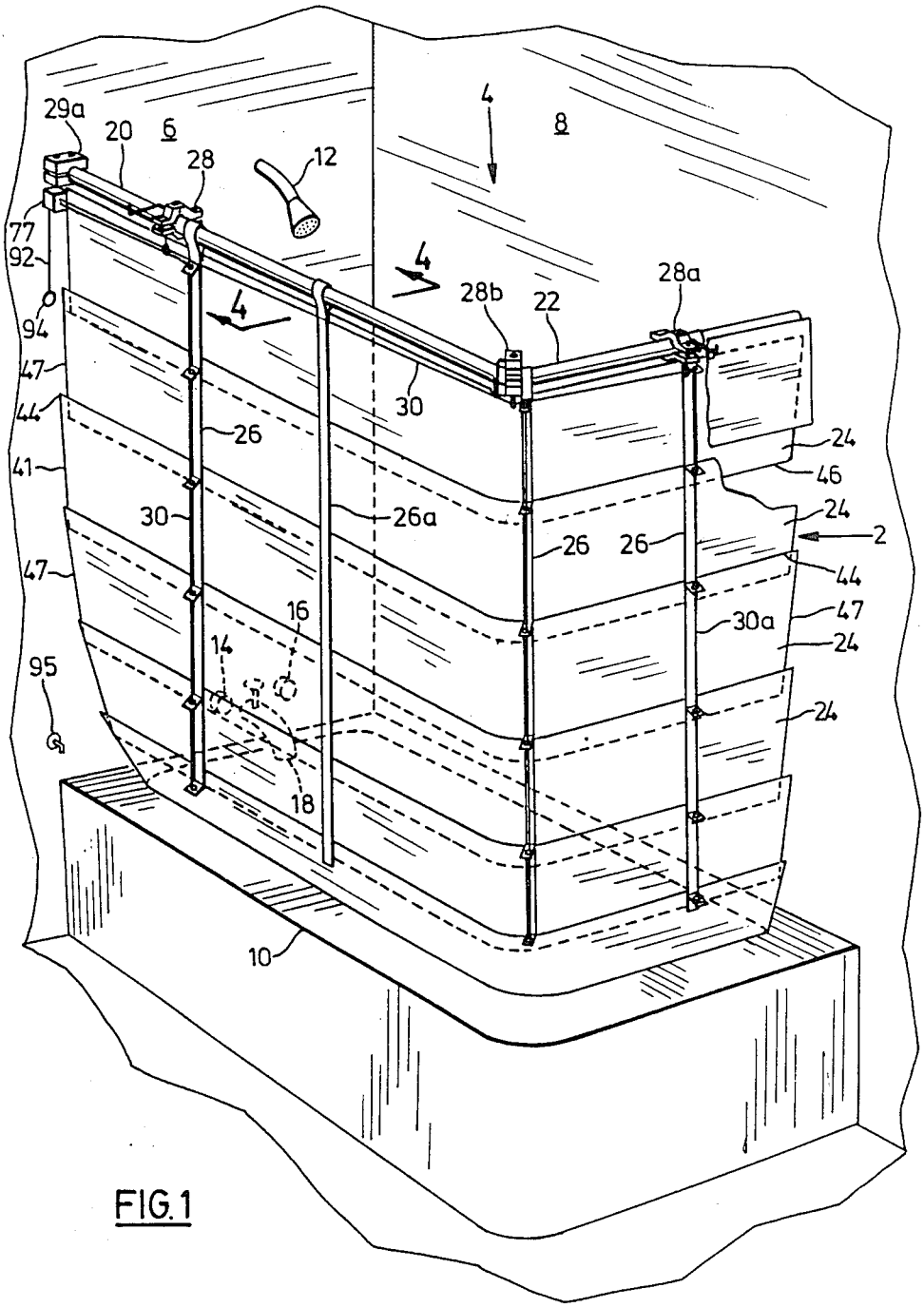
FIG. 1 is a perspective view showing a shower curtain in the lowered position in place around two sides of a free-standing tub.

FIG. 1 shows a shower curtain, indicated generally at 2, in place around a shower, indicated generally at 4. The shower 4 has an end wall 6 and a side wall 8. At the foot of the end wall 6 and the side wall 8 is located a tub 10. The end wall 6 has a shower nozzle 12, hot and cold water taps 14 and 16, and a tub faucet 18 (shown in ghost outlines) protruding therefrom in a conventional manner. Also shown is a shower rod 20, which extends from the end wall 6 around corner 22 and to the side wall 8.

In the embodiment illustrated in FIG. 1, the shower curtain 2 is shown having a plurality of waterproof panels 24, a hanging means comprising a number of hanging straps 26 and a raising and lowering means comprising a number of clamps 28, and drawstrings 30.

Figure 2:
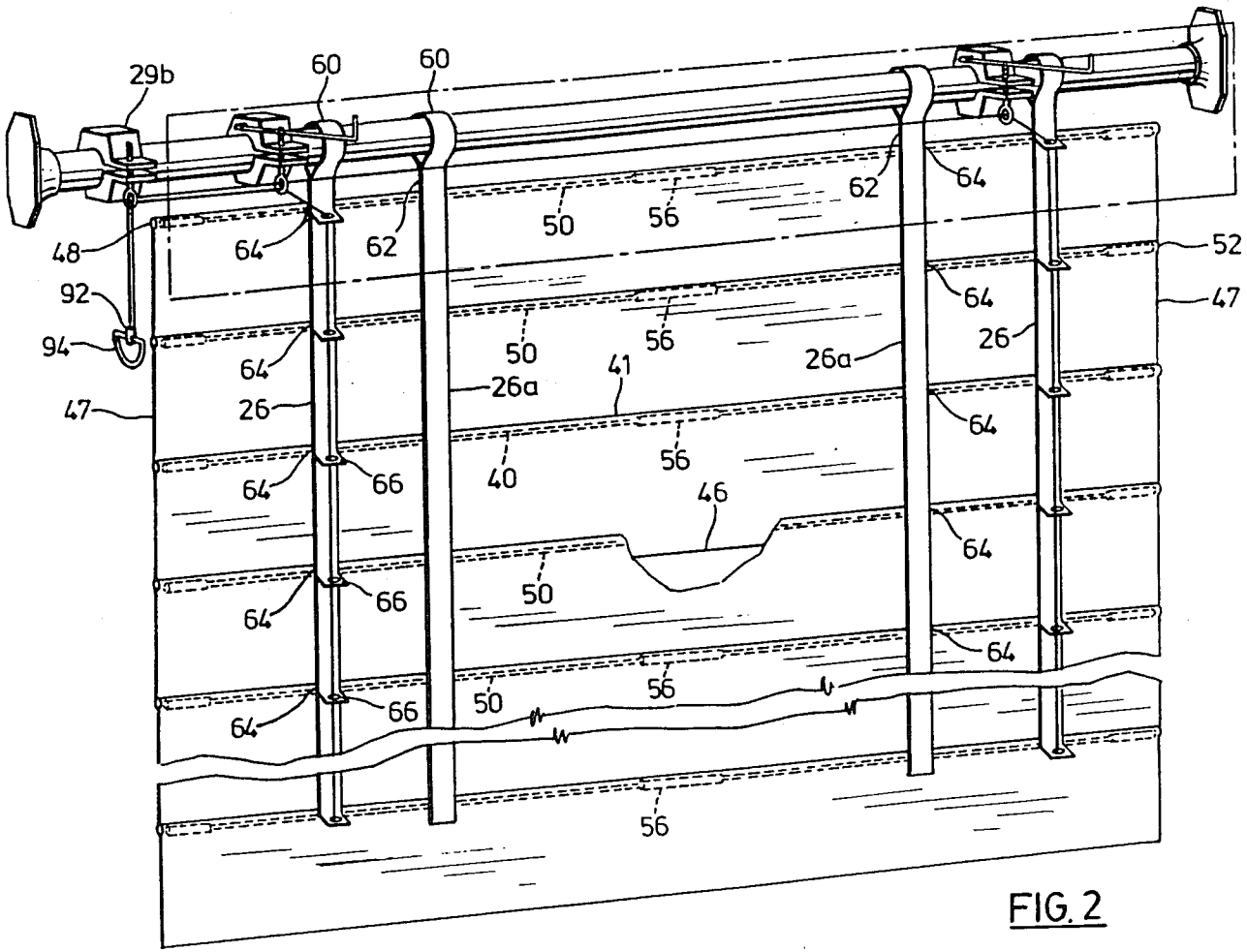
FIG. 2 is perspective view showing a shower curtain in the lowered position in place across one side of a conventional tub.

Each waterproof panel 24 is in the form of a waterproof sheet 41, that has an upper edge 44, a lower edge 46, and side edges 47. Sheets 41 are preferably made of a thin lightweight plastic. Along the uper edge 44 is formed a sleeve 48 as shown in FIG. 2. Sleeve 48 may be formed by folding over the upper edge 44 of the sheet 41 and attaching it by any conventional manner such as by gluing, stitching or laser, heat or sonic welding.

Also shown in FIG. 2, in dotted outline are deformable stiffening rods 50 located in sleeves 48 of each panel 24. Rods 50 in turn have end caps 52, and may be joined end to end to any desired length by tubular connectors 56. The end caps 52 are to prevent the rods 50 from penetrating the material of sheet 41. Rods 50 perform two functions. Firstly, the rods 50 provide a stiff upper edge to each panel 24, which upper edge is free from substantial deflection across any unsupported or cantilevered span. Secondly, the rods 50 are deformable, and can be bent to conform to any shape of free-standing tub. For example, if it is desired to enclose a tub 10 with only one end wall 6 as depicted in FIG. 1, the rods 50, located in each panel 24, can be bent in an appropriate place to conform to the bend 22 in the shower rod 20. In this manner, any shape of free-standing but 10 can be accommodated by appropriate non-elastic deformation or bending of rods 50.

In the embodiment shown in FIG. 2, the shower curtain 2 is shown having four hanging straps 26, which support the panels 24 in an inwardly overlapping relationship when the shower curtain 2 is in the lowered position. Straps 26 may also be composed of any suitable lightweight plastic. Each strap 26 has an upper end 60, which is attached to some support structure. In the preferred embodiment, upper end 60 is passed over a conventional shower rod 20, and then is attached back to strap 26 at 62. Upper end 60 may be either permanent or releasably attached to strap 26 at 62, but in the preferred embodiment a releasable attachment is used. For example, Velcro fasteners, buckles and matching male-female attachment members could all suitably be used to releasably secure the upper end 60 to strap 26 at 62.

Hanging straps 26 are attached to each panel 24, adjacent to each rod 50 at the upper edge 44 at points 64. As sheet 41 is of a flexible lightweight material, it will be appreciated that straps 26 are preferably attached adjacent each rod 52. Also, to align panels 24 in the lowered position, points 64 should be located the same distance from side edges 47. For two of the straps 26, a fold 66 is formed in each strap 26 opposite points 64. The other two straps are given the reference 26*a*, and are not provided with folds 66. In each of the folds 66 is located a grommet 68, which is more fully described below. It has been found that the two support straps 26a may be added to increase the support for the panels 24.

It will now be understood that panels 24 are suspended directly from hanging straps 26, when the shower curtain 2 is in the lowered position. Each panel 24 is essentially hinged about the upper edge 44 of sheet 41, and each lower edge 46 of each sheet 41 is free to rotate inwardly, towards the shower nozzle 12. When the water is turned on, creating air drafts, the lower edges 46 tend to rotate inwardly in response to the pressure difference created between the inside of the shower enclosure and the outside. As the lower edges 46 swing inward, the pressure difference is relieved almost immediately, and the lower edge 46 is then free to swing back, so panel 24 is again essentially vertically aligned, by the force of gravity. Because lower edges 46 are flexible, the full length of lower edge 46 will not usually be displaced, but rather the displacement will occur in more localized areas. As a result, when in use, the shower curtain 2 appears to flutter.

A particular advantage of this configuration is that even though gaps open up between panels 24 to allow air to flow inwardly, because of the inward overlap, the shower curtain at all times remains watertight and prevents water from escaping from the shower enclosure. Also, because the height of each panel 24 is relatively small in comparison to the overall height of the shower curtain 2, and because of the flexible nature of the lower edge 46, the inward displacement of the shower curtain 2 is quite small. Consequently, the shower curtain 2, when in use, is not likely to interfere with a person taking a shower.

As shown in FIGS. 1 and 2, the shower curtain 2 incorporates a number of clamps 28, an end clamp 29, and drawstrings 30 with one draw string 30 for each strap 26 with grommets 68. The number of clamps 28 and drawstrings 30 is variable, and will depend on the length and configuration of the shower rod 20.

Figure 4A:
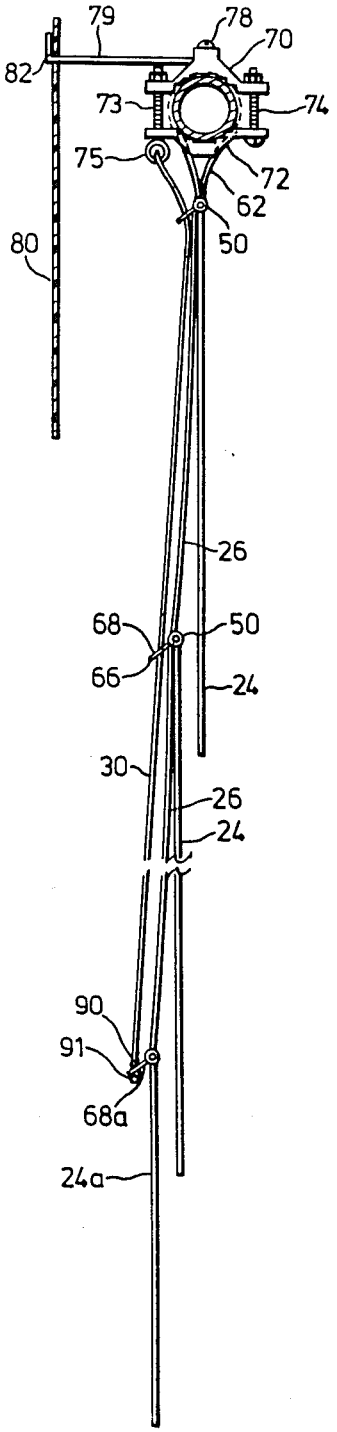
FIG. 4*a* is an enlarged cross-sectional view along line 4—4 of the shower curtain of FIG. 1 in a lowered position.
Figure 4B:
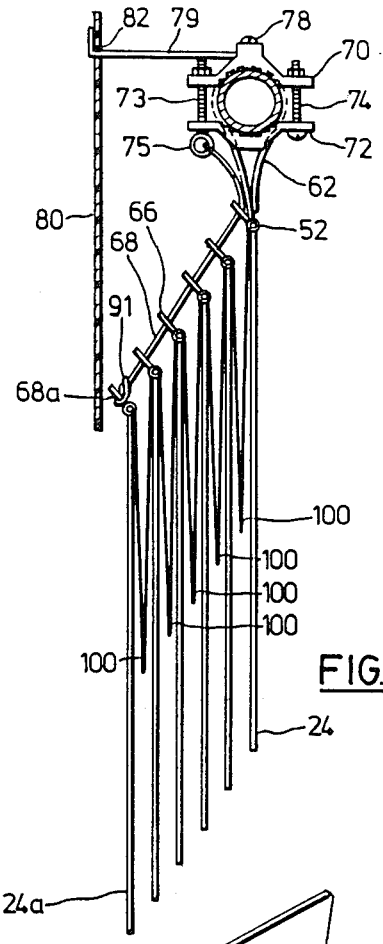
FIG. 4*b* is an enlarged cross-sectional view along the line 4—4 of the shower curtain of FIG. 1, in a raised position.
Figure 3:
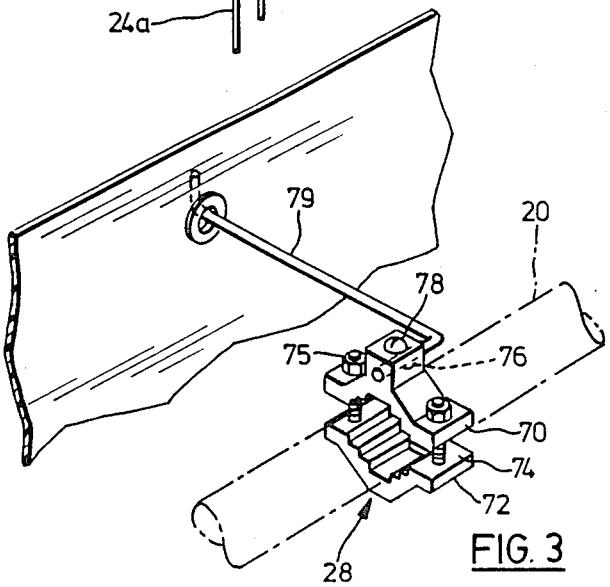
FIG. 3 is an enlarged perspective view from above and behind showing a clamp element of the shower curtain of FIGS. 1 or 2.

Referring to FIG. 3, a clamp 28 is shown in detail. The clamp 28 has an upper clamping member 70, and a lower clamping member 72. Bolts 73 and 74 are used to connect upper clamping member 72 to lower clamping member 28 around the shower rod 20 (shown in ghost outline). As can be seen in FIGS. 4*a* and 4*b*, the head of bolt 73 is in the form of an eyelet 75. Referring back to FIG. 3, the upper clamping member 70 has a bore 76 into which extends a set screw 78. A valence panel support member 79 is inserted into the slot 76, and is held in place by the set screw 78.

Referring back to FIG. 1, in the preferred embodiment the shower curtain 2 also has a valence panel 80, which is supported from the valence panel support members 79. Valence panel 80 is substantially in the form of waterproof panels 24, with one exception. Valence panel 80 is equipped with grommets 82, located near the upper edge 84, through which valence panel support members 79 are inserted. In this manner, valence panel 80 is supported in place in front of the shower rod 20, and hides the workings of the shower curtain 2, thereby enhancing the attractiveness of the invention.

The other element of the raising and lowering means are drawstrings 30, shown in FIGS. 1 and 2. As can be seen clearly in FIG. 4*a*, drawstrings 30 have one end 90 attached to a grommet 68*a* located in hanging strap 26 at the upper edge of lowermost, outermost panel 24*a*. The end 90 may be attached in any suitable manner, such as by knot 91. The other end 92 of drawstrings 30 are passed up through grommets 68 located opposite successive upper and inner panels. Then, end 92 is passed through an eyelet 75 of bolt 73 of clamp 28. It will be appreciated that clamps 28 are preferably located adjacent hanging straps 26 to facilitate the smooth running of drawstring 30. In addition, pulleys (not shown) may be suspended from eyelets 75 to facilitate the smooth running of drawstrings 30. For example, in FIG. 1, pulley 77 is shown attached to end clamp 29*a*.

End clamp 29 may also be of the form of end clamp 29*b*. shown in FIG. 2.

Ends 92 of drawstrings 30 are then led towards end wall 6, and are passed through eyelets 75 of all clamps 28 located along the shower rod 20, between where such drawstring 30 originates, and end wall 6. For example, in FIG. 1, drawstring 30*a* would pass through an eyelet 75 on clamp 28*a*, then through an eyelet 75 on clamp 28*b*, and so on until it passed through the eyelet 75 or the pulley 77, on end clamp 29*a* or 29*b* respectively. All drawstrings 30 are guided past end clamp 29, and the ends 92 are all attached to a pulling device, such as pull ring 94. In this manner, pull ring 94 is located near end wall 6.

The operation of the shower curtain 2 can now be more fully understood. Beginning with the lowered position, the pull ring 94 will hang down relatively closely below shower rod 20 from end clamp 29, and will be close to end wall 6. As pull ring 94 is pulled lower, drawstrings 30 will begin to move. As ends 92 are pulled down, ends 90 are pulled up. Then, the lowermost panel 24*a* begins to be taken up. When the lowermost panel is raised level with the next uppermost panel, the two panels 24 and 24*a* will begin to be taken up. As pull ring 94 is pulled down further, more and more panels 24 are taken up, until all of the panels are in a nested position, closely adjacent eyelets 75 of clamps 28, as depicted in FIG. 4*b*.

Once the shower curtain 2 is in the raised position, the pull ring 94 may be temporarily secured to a cleat or hook 95, in a conventional manner. Depending upon the length of drawstrings 30 in the raised position, it may be necessary to employ two hooks, and pass the drawstrings 30 around the two, to accommodate any excess length (not shown). In this manner, the shower curtain will be maintained in the raised position.

A particular advantage of this configuration of hanging straps 26, clamps 28 and drawstrings 30 can now be understood. As the shower curtain 2 is being raised, hanging straps 26 will begin to fold over, into folds 100 shown in FIG. 4*b*. Because of the location of drawstrings 30, and the manner that the panels 24 are hung by folds 66 in straps 26, folds 100 will tend to form between adjacent panels 24. Although hanging straps 28 are flexible, because folds 100 form between adjacent panels 24, the panels 24 are separated to some degree. In this manner, panels 24 can more readily air dry, after the shower curtain 2 has been in use, thereby preventing mold or mildew from growing on the panels 24.

We claim:

1. A vertically drawn shower curtain suspended from a generally horizontally extending rod positioned above a bath tub, said curtain, having a raised position and a lowered position and being moveable therebetween, said shower curtain comprising:

(a) a plurality of flexible waterproof panels each having an upper edge and a lower edge, (b) a means for hanging said panels from said rod in an overlapping relationship with said overlap being towards the tub interior, said panels being suspended by said upper edges from said hanging means, said lower edges of each of said panels being free to rotate inwardly toward the tub interior and upwardly toward said rod when said shower curtain is in the lowered position; and (c) a means for raising and lowering said shower curtain, said panels, in the raised position being suspended in a side by side relationship from said raising and lowering means and at least a portion of said hanging means being located between every adjacent panel to maintain the panels in spaced apart relationship to allow the panels to air dry.

2. A shower curtain as claimed in claim 1 wherein said hanging means comprises at least two flexible elongate members attached to each of said panels.

3. A shower curtain as claimed in claim 1 for use around a shower having a shower rod, wherein said hanging means comprises: at least two flexible elongate members attached to each of said panels; a plurality of guide elements located in said elongate members adjacent to where said members are attached to each of said panels; and a means for fastening said elongate members to the shower rod.

4. A shower curtain as claimed in claim 1, or 3, wherein said raising and lowering means comprises:

a plurality of clamps each having a second guide means; and at least one drawstring, each drawstring having one end attached to the lowest, outermost panel, and having the other end threaded through guide elements attached to successive upward and inward panels and then passing through said second guide means and terminating in a pull end;

whereby, upon pulling said pull end, and thereby said drawstring, said panels are raised to a nested spaced apart relationship, and upon releasing said pull end, said panels are lowered into an inwardly overlapping relationship in the lowered position.

5. A shower curtain as claimed in claim 3, wherein said raising and lowering means comprises:

a plurality of clamps each having a second guide means; and at least two drawstrings, each of said drawstrings having one end attached to the guide element adjacent the lowest, outermost panel, and having the other end threaded through said guide elements in successive upward and inward panels and then passing through said second guide means and terminating in a pull end;

whereby, upon pulling said pull end, and thereby said drawstrings, said panels are raised to a nested spaced apart relationship, and upon releasing said pull end, said panels are lowered into an inwardly overlapping relationship in the lowered position.

6. A shower curtain as claimed in claim 5, wherein each flexible elongate member includes a fold where it is attached to a panel, with each fold including an opening, in which a respective guide element is located.

7. A shower curtain as claimed in claim 5, wherein said hanging means comprises at least three flexible elongate members attached to said panels, with there being a flexible elongate member for each drawstring, each such flexible elongate member including a fold where it is attached to a panel, which fold includes a respective guide element through which the respective drawstring passes, and with there being at least one, plain, flexible elongate member attached to said panels.

8. A shower curtain as claimed in claim 5, 6 or 7, wherein each drawstring extends upwardly to a respective clamp and extends laterally away from the clamp.

9. A shower curtain as claimed in claim 5, wherein each drawstring extends upwardly to a respective clamp, and extends laterally away from the clamp and which includes a means for securing the drawstrings in a position holding the panels in the raised position.

10. A shower curtain as claimed in claim 5, 7 or 9, which includes at least one end clamp, through which the drawstring extends.

11. A shower curtain as claimed in claim 1, 3, or 5 wherein each said waterproof panel comprises: a waterproof sheet having an upper edge; a lower edge; a sleeve formed along said upper edge; and an elongate deformable stiffening member carried within said sleeve.

12. A shower curtain as claimed in claim 5, which includes a valence panel suspended from said clamps.

13. A shower curtain as claimed in claim 6, 7 or 9, wherein each said waterproof panel comprises: a waterproof sheet having an upper edge; a lower edge; a sleeve formed along said upper edge; and an elongate deformable stiffening member carried within said sleeve.

14. A shower curtain as claimed in claim 5, 7 or 9, wherein at least two of the clamps include a valence panel suspending hook and which includes a valence panel suspended from the valence panel suspending hooks.

* * * * *